US006447395B1

(12) United States Patent
Stevens

(10) Patent No.: US 6,447,395 B1
(45) Date of Patent: Sep. 10, 2002

(54) GAME TICKET SYSTEM TO BE PLAYED WITH KENO

(75) Inventor: Mark Stevens, Omaha, NE (US)

(73) Assignee: International Gamco, Inc., Omaha, NE (US)

( * ) Notice: Subject to any disclaimer, the term of this patent is extended or adjusted under 35 U.S.C. 154(b) by 0 days.

(21) Appl. No.: 09/862,534

(22) Filed: May 21, 2001

Related U.S. Application Data

(63) Continuation of application No. 09/141,191, filed on Aug. 27, 1998, now abandoned.

(51) Int. Cl.[7] ..... G06F 17/00

(52) U.S. Cl. ..... 463/18; 463/17; 273/269; 273/139; 283/903

(58) Field of Search ..... 463/17, 18; 283/903; 273/269, 270, 139

(56) References Cited

U.S. PATENT DOCUMENTS 5,046,737 A * 9/1991 Fienberg ..... 273/139
5,158,293 A * 10/1992 Mullins ..... 273/139
5,671,921 A * 9/1997 Quinlan ..... 273/139

* cited by examiner

*Primary Examiner*—Joe H. Cheng
*Assistant Examiner*—Julie Brocketti
(74) *Attorney, Agent, or Firm*—Sonnenschein, Nath & Rosenthal

(57) ABSTRACT

A game ticket system to be played in conjunction with a live action game, and a method of using the game ticket system. The game ticket system includes a plurality of game tickets having one or more play results, where some tickets indicate fixed play results and some indicate a hold play, and where a hold play identifies a result from a live action game. The game ticket system is used by distributing the tickets to players, revealing to the players the results of the game tickets, playing a live action game, and determining if any player holds a ticket with a hold play result which matches some result of the live action game.

4 Claims, 2 Drawing Sheets

GAME TICKET SYSTEM TO BE PLAYED WITH KENO

CROSS REFERENCE TO RELATED APPLICATIONS

This application is a Continuation Patent Application under 37 CFR 1.53(b) based on parent application Ser. No. 09/141,191, filed Aug. 27, 1998 now abandoned.

BACKGROUND OF THE INVENTION

1. Field of the Invention

This invention relates to an article of manufacture and its method of use. In particular, the invention relates to a game ticket system comprising one or more play results being concealed and provided to players on a ticket, the play results potentially leading to an opportunity to win prizes dependant on the outcome of a live-action game.

2. Discussion of the Related Art

Game ticket systems provide both a popular form of entertainment to players of the game and a source of income to providers of the tickets. These providers include state governmental bodies, charities, and private organizations. The providers may sell the tickets, or they may distribute them as promotions.

For players, the greater the entertainment value, the more they enjoy playing the game. For providers, the greater the entertainment value, the more effective the game ticket system is in generating ticket sales or promotional affects. For providers selling the tickets in conjunction with other products or services, the entertainment value also provides an incentive to bring in players, who in turn use the other products or services. Thus, the entertainment value is directly related to the successful use of game ticket systems.

Accordingly, modifications of game ticket systems that provide enhanced entertainment value can benefit both the players and the providers. Therefore, it is a desideratum to design game ticket systems with novel features to enhance their entertainment value.

A basic and popular form of a game ticket system consists of a plurality of tickets, each ticket having a single exposure device concealing printed indicia of one or more play results until the exposure device is removed. Pull-tabs and scratch-off surfaces are two common forms of exposure devices. For a pull-tab, removal entails opening the pull-tab to display the play result or results lying underneath. For a scratch-off surface, removal entails scraping off a portion of the surface to display the play result or results lying underneath.

Once exposed, a play result displays the value of the play. Different types of play results present the values in different formats. For example, a direct play result presents the value explicitly by showing the prize, if any. Other types of play results depict an encoded value, which must be interpreted. A common example of an encoded play result is a plurality of symbols associated with the display of a slot machine. Certain combinations of symbols correspond to winning plays. Regardless of format, with this basic form of game ticket system, each ticket has a predetermined play result value. And, since there is but a single exposure device, the player always knows if the ticket includes a winning value once the exposure device is removed.

A disadvantage of this type of game ticket system is that all opportunity for winning prizes is determined immediately, i.e. as soon as the exposure device is removed. This results in either immediate satisfaction or immediate disappointment on the part of the player, with no ability for the ticket provider to create a period of heightened anticipation or excitement during which the player knows the play outcome which he or she has selected or been assigned, but must wait for a period of time to determine if that play outcome will result in a winning play. Consequently, this type of game ticket system results in only being able to provide limited and immediate entertainment value and enjoyment for players.

In the unrelated field of live action gaming systems, the game of keno is well known. In keno, a player uses a keno game card to select a plurality of numbers between one and eighty, which in the game are know as "spots." Normally the player may select as many as ten spots, or as few as four. Naturally, variations in the amount of spots which may be chosen occur from gaming establishment to gaming establishment. Normally, the game card is then submitted to the official of the gaming establishment, such as the agent of a state lottery at a bar or restaurant, prior to the beginning of the game play period. During the game play period, the gaming establishment draws twenty numbers between one and eighty in some random fashion, and if all, or some previously identified fraction of the player's spots are drawn, he or she wins a pay amount. The odds against winning, and the corresponding payout for a winning keno game card, increase as the number of spots selected by a player increases. Game play periods last for a few minutes, and normally occur consecutively throughout the day or evening, with short breaks between each game to allow players to purchase additional tickets or refresh themselves prior to the commencement of another game play period.

A disadvantageous feature of this system is that once the player decides how many spots to choose, and then chooses the spots themselves, the player's participation in the game ends. This situation means that the player often has little or no reason to remain in the gaming establishment after submitting his or her keno game card, and it is common practice for keno players to purchase and submit keno game cards for multiple consecutive games, then leave the gaming establishment during the game play to engage in other activities, and only return after the game play periods for their keno game cards are concluded, to determine their winnings. Ultimately, this results in the disadvantage of reduced excitement and enjoyment for players.

This feature also results in the disadvantage of reduced revenues for gaming establishments. Reduced revenues occur because players often fail to purchase additional keno game cards upon their return to the gaming establishment and, because players are not physically present during the game play, they do not purchase additional products and services, such as food and drinks, when they leave the Keno gaming establishment during game play.

Another disadvantage with keno-type games is that at some point during the game play period, enough numbers will have been randomly selected to make it impossible for certain keno players to win with the keno game card they hold for the current game. For example, with a keno game card on which ten spots have been selected, after the gaming establishment has already randomly drawn eleven out of twenty numbers, and none of those eleven numbers match the player's chosen spots, it then becomes impossible for the player to win a significant payout on that keno game card. Among players who have stayed in the gaming establishment during the game play period, the knowledge of this certainty often causes frustration and disappointment, and frequently results in the player leaving the gaming establishment and refraining from purchasing additional keno game cards, products or services.

Some attempts have been made by providers of keno-type games to maintain player interest and attendance by offering free promotional items during the game play or tying receipt of these promotional items to the presentation of a current keno game card when the player's name is randomly draw and announced during the game play period. However, these efforts have met with only limited success, because the promotional items offered often fail to create excitement among keno players. Additionally, the offering of these free promotional items reduces the profitability of a given keno game period, because the gaming establishment is forced to purchase the promotional items in the hope that they will stimulate the player's interest and attendance, however the promotional items provide no direct financial return to the gaming establishment. Thus, these promotional items serve as a financial drain on the gaming establishment, while not providing significant added excitement and enjoyment for the keno players.

It is known within the bingo game industry to increase revenues by offering a game ticket system which consists of a plurality of game tickets, each having a single exposure device concealing printed indicia of one or more play results which are tied to a bingo number to be called in the next bingo game to be played. For example, a bingo player would be able to purchase a single exposure device, which, when exposed, would identify a bingo number, and the order in which that number must be called, e.g., "B-5, First Number. " These game tickets serve to create additional revenues for bingo, however, bingo varies from keno in that in the game of bingo players are required to attend the game play period in order to win, and a significant amount of player activity and participation is already involved in bingo. Accordingly, the sale of game ticket systems for the game of bingo create additional revenues, but probably do not create significant added player interest, excitement, enjoyment or attendance during the game play period.

As a result, there is a need for a gaming system which can be played in conjunction with the game of keno which can increase player excitement and attendance during the game play period, while at the same time providing an additional source of revenue to gaming establishments. The entertainment value of a game ticket system is difficult to predict and, thus, there is no formula for designing successful game ticket systems. Accordingly, there has existed a definite need for game ticket systems having enhanced entertainment value. The present invention provides this and related needs.

SUMMARY OF THE INVENTION

The present invention provides a game ticket system for use with live-action, keno-type games. The game ticket system provides enhanced entertainment to players of the game ticket system and an enhanced source of income and promotional benefits to providers of the game ticket system.

The invention includes a plurality of game tickets. Each game ticket includes one or more play results, each play result having a value. The play results are hidden from view, encoded, or otherwise not accessible to players by inspection. The game tickets are sold or otherwise distributed to players in this form and, thus, the value of each play result are concealed from the players when the game tickets are distributed. The play result value is revealed at some point after the game tickets are distributed.

A feature of the present invention is that the play result values appear in two forms. A first type of play result value may indicate, either literally, or by means of an encoded value, that the player has won a fixed amount of money. Naturally, amounts, and the number of game tickets bearing those amounts may be varied by the game ticket producer. A second type of play result may indicate, either literally, or by means of an encoded value, that the ticket is not a winning ticket. A third type of play result value will indicate a hold play. The hold play will identify a number in the set of numbers used in the keno game, normally between one and eighty. The player then must hold the ticket to see if the number indicated by the hold play result matches a number chosen during a predetermined selection, such as, for example, the last number selected during the game play period of the live action keno game. If the hold play result does match the number called, the player wins the indicated jackpot amount. If the hold play result does not match, the game ticket is not a winning ticket.

This feature thus significantly enhances the pleasure of playing the game ticket system. By linking the possibility of winning a jackpot amount to the outcome of a live action keno game, the game ticket system significantly prolongs the excitement and anticipation which the player can experience while playing the same ticket system. This results from requiring the player to wait through the entire play period of the live action keno game to determine what the last number called will be before the player is able to determine if his or her hold play result indicates a winning game ticket.

Another advantage of this feature is that a hold play result encourages the player to remain within the keno gaming establishment during the keno game play period so that the player can wait to see if his or her hold play result indicates a winning game ticket.

Consequently, because the player remains in the gaming establishment, this increases the possibility that the player will purchase additional goods and services from the gaming establishment, thereby increasing the player's enjoyment of their gaming experience and increasing sales and revenues for the gaming establishment.

A still further advantage of the hold play result feature is that it provides an additional and unique opportunity for players to win prizes while playing the game of keno.

In essence, it allows players who have not been successful in the live action keno game play period to have purchased a "second chance" at winning. This increases player enjoyment of the live action game of keno and can also reduce player frustration when they are not winning while playing the live action keno game. This feature also provides the distributor with additional advantages. The enhanced enjoyment of the players will attract more players and will increase revenues or promotional effects. Thus, these advantages heighten the pleasure of winning and, thus, the anticipation of all players while playing the game.

A preferred feature of the present invention is that the tickets of the game ticket system are distributed by the gaming establishment conducting the live action game. Also preferrably, a fixed number of tickets are part of a single lot of tickets, and all tickets from that lot are distributed prior to the determination of a hold play result winning ticket from that lot. Thus, tickets may be distributed during the periods of play of several live action games, but the hold play results will be linked only to the outcome of a single live action game play period beginning sometime after the distrubution of all game tickets.

An advantage of this feature is the further encouragement of players of the live action keno game to remain in the gaming establishment. Because players who have purchased tickets that have hold play results cannot determine if their hold play is a winning play result until all tickets of that lot have been sold, players will naturally tend to remain in the gaming establishment until the winning number is determined. A further advantage of this feature is that, in some instances, it encourages players with hold play results to purchase additional tickets, both to increase their odds and so that the winning result will be determined more quickly.

Another feature of the invention is that the game tickets may include one or more exposure devices, each of which conceals one or more of the play results. The exposure devices prevent the exhibition of the game ticket play result values until the exposure device is removed. Advantageously, this feature enhances a player's enjoyment of the system with the visceral experience of revealing the play results, rather than just informing the player of the winning and losing values. It also allows players to feel that they are receiving "more than one second chance" with the purchase of a single game ticket, and thus make players feel that they have received many opportunities to win prizes during the live action keno game play periods, rather than the single opportunity to win associated with a single keno game card.

Other features and advantages of the present invention will become apparent from the following description of the preferred embodiments, taken in conjunction with the accompanying drawings, which illustrate, by way of example, the principles of the invention.

DESCRIPTION OF THE PREFERRED EMBODIMENTS

Figure 1:
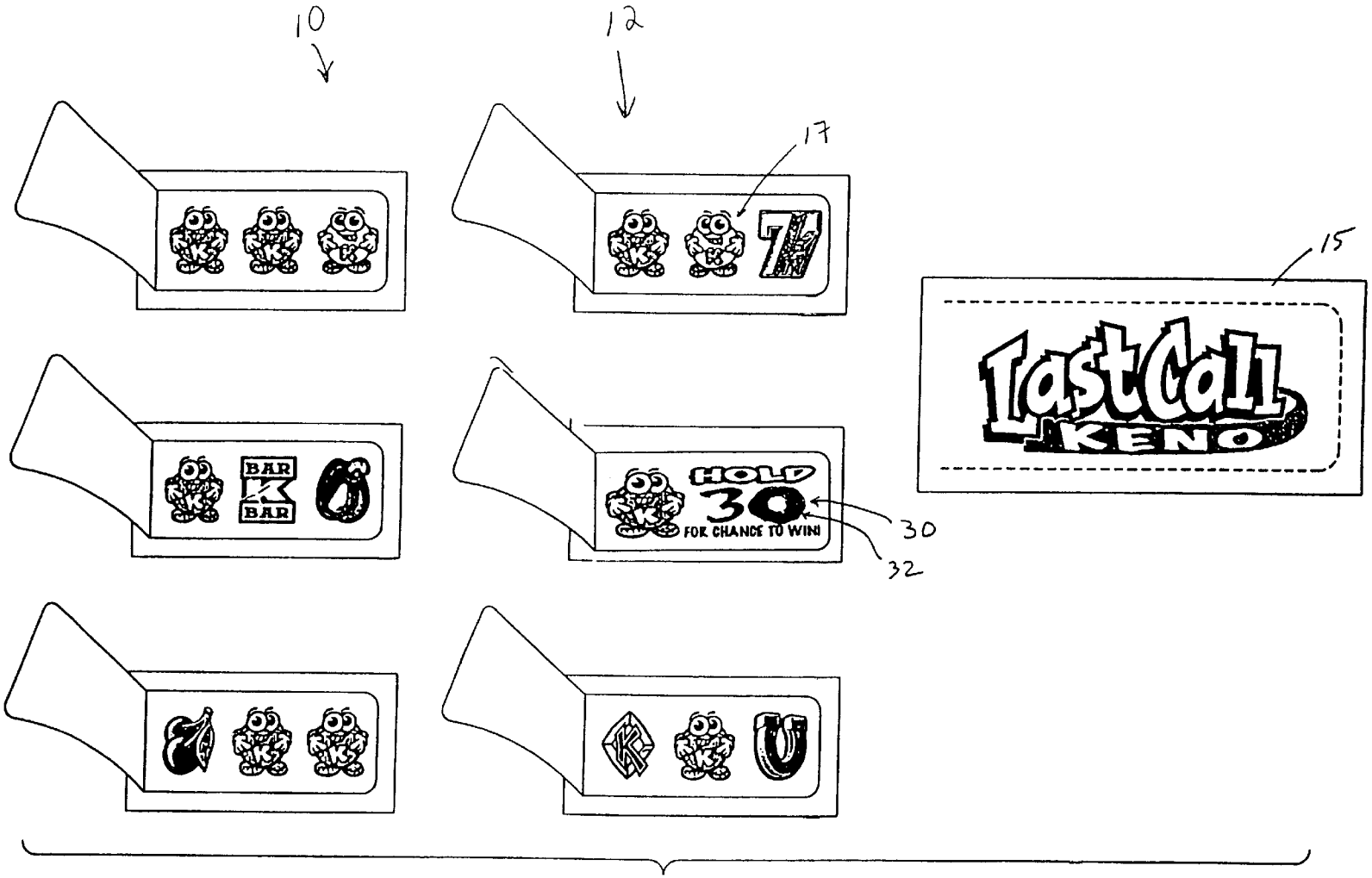
FIG. 1 is a view of a first embodiment of a game ticket system including a plurality of game tickets for game play in conjunction with the game of keno in accordance with the present invention.

A game ticket system 10 according to the present invention is shown in FIG. 1. The game ticket system includes a plurality of game tickets. (Not all shown.) In a representative embodiment, the game ticket system includes 720 game tickets, but, any number of game tickets could be provided for.

Figure 2:
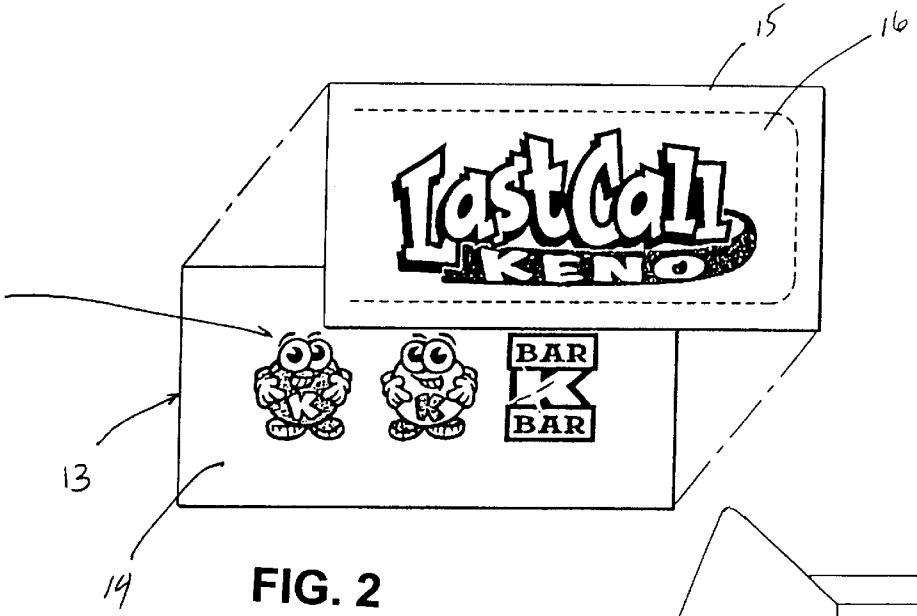
FIG. 2 is an exploded view of one game ticket as used in the game ticket system of FIG. 1.

Referring additionally to FIG. 2, each game ticket 12 includes a base card 13 with a playing surface 14, and a top card 15 affixed to the base card so as to conceal the playing surface. The top card includes an exposure device, which is preferably a perforation defining a pull-tab 16 that may be removed to expose a portion of the playing surface having a play result 17 printed thereon. The play result is thus concealed until the exposure device is removed. Alternative variations of the game ticket system may include other methods of concealing game ticket play results (such as coded play results), may include other game ticket exposure devices such as scratch-off surfaces, may have more than one exposure device on each game ticket and/or may include more than one play result under each game ticket exposure device.

As shown in FIG. 1, each game ticket play result 17 symbolically depicts a play result value in a slot machine (three pictures) format with certain play results indicating a fixed play result value. In the representative embodiment, these fixed play results have values of fifty dollars (contained on two game tickets, not shown), twenty-five dollars (contained on two game tickets, not shown), five dollars (contained on four game tickets, not shown), two dollars (contained on ten game tickets, not shown), and one dollar (contained on one-hundred and four game tickets, not shown). Thus, $494 (2*$50+2*$25+4*$5+10*$2+104*$1) in fixed play result value is included in the game ticket system. The game may also include fixed play results with no prize value (contained on five-hundred eighteen game tickets, not shown). Naturally, other formats of play result indications, including numeric play result values, and different play result values from those identified above, are within the scope of the invention.

Other play results 17 also include a group of symbols 30 representing a hold play (contained on eighty tickets, not shown). The hold play result indicates that the player must hold the ticket until the end of the live action keno game play period. The hold play result also identifies a keno number 32. At some time during the game play period, generally at the end of the game play period immediately after all the tickets have been distributed, a predetermined selection, e.g., the twentieth number, will be made. If the hold play result of the game ticket held by the player matches the number selected, the player wins the jackpot or top prize amount of two-hundred dollars.

Generally, odds for the game may be set to either increase or decrease the possibility of a game ticket player winning, depending on the needs and preferences of the gaming establishment. However, odds are preferrably set to guarantee a minimum expected return to the gaming establishment. The odds that a player will receive a game ticket with a winning hold play result are easily calculable. For illustration, in the representative embodiment described above, the odds that the twentieth number selected as the winning number, will match a given hold play result, is calculated as follows.

First, the probability that a player will receive a hold play result is eighty out of seven hundred-twenty, or 1/9. In the representative embodiment, 720 single exposure game tickets are contained within a set of game tickets. Next, the probablility that a given hold play result will match the preselected, randomly draw number, e.g., the twentieth number, is one in eighty. Multiplied by 1/9, the odds that a player will both receive a game card having a hold play result, and that hold play result will be a winning play is 1/720 or about 0.139 percent. However, it is important to note that because all the tickets are distributed prior to determining a winning hold play result, there will always be a hold play result winner. Accordingly, the odds of winning are sufficiently high that players will not lose interest in playing the game, but not so high that gaming establishments risk losing money on the game ticket system.

In operation, game tickets 12 from the game ticket system 10 are distributed by one or more distributors (i.e., people or machines) to a plurality of players. Preferrably, all of the tickets must be distributed prior to playing the game ticket system. Also, it is preferrable that distribution of the tickets be conducted simultaneously with the playing of the the live action game. Thus, several live action game play periods may pass during the distribution of the tickets. When all game tickets are distributed, the gaming establishment may announce that the game tickets will be in play for the next live action game play period, or some later game play period. Preferably a larger number of distributors are used to facilitate rapid distribution of the game tickets. Upon receipt of a game ticket, each player removes one or more exposure devices 16 to expose play results 17 indicating the play result value of the ticket, which includes an indication of whether the player receives a fixed play result, or a hold play. The announced live action keno game to which the game tickets system is linked is then played, i. e., twenty numbers are randomly selected. Players who have tickets indicating hold play results then determine whether their hold play result matches indicates a number which matches the predetermined keno number called. If a match exists, the winning player may redeem the winning ticket with the gaming establishment to collect their prize.

Figure 3:
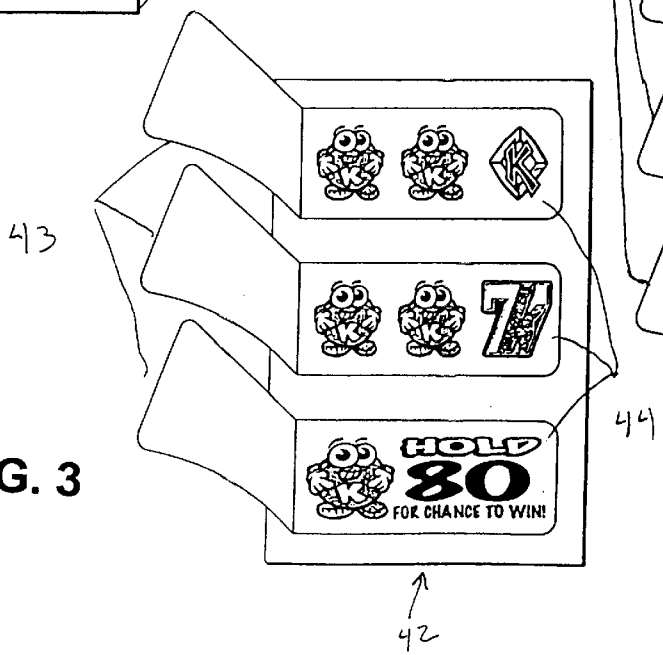
FIG. 3 is a view of an alternate game ticket having three exposure devices for use with a game ticket system in accordance with the present invention.

FIG. 3 depicts a game ticket 42 for use with an alternative embodiment of a game ticket system in accordance with the present invention. The game ticket includes three pull tabs 43 that may be opened to expose three play results 44. A multitude of such game cards may be used with the game ticket system to be played in conjunction with a live action game of keno of the previously described embodiment.

Figure 4:
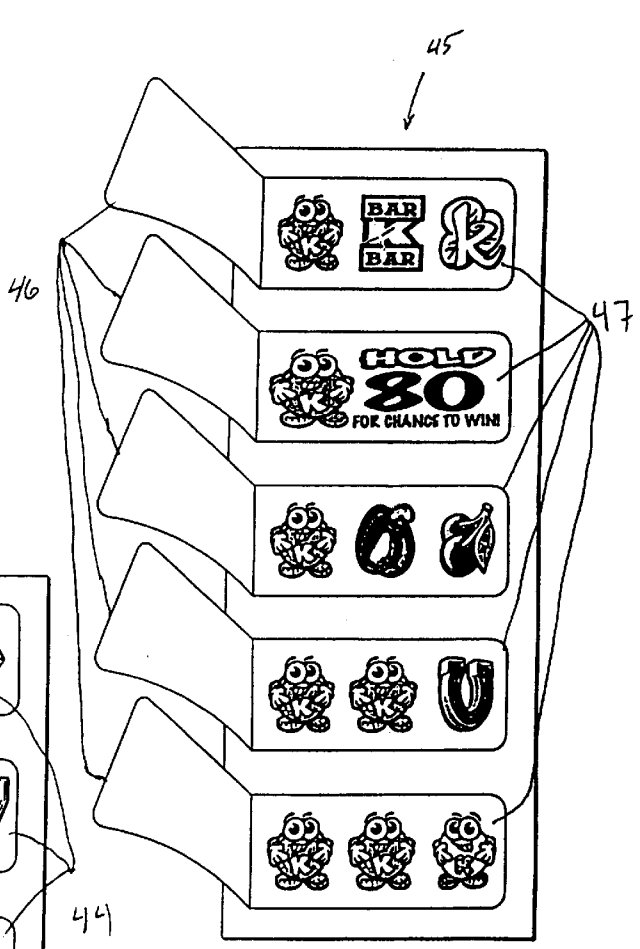
FIG. 4 is a view of another alternate game ticket having five exposure devices for use with a game ticket system in accordance with the present invention.

FIG. 4 depicts another a game ticket 45 for use with still another embodiment of a game ticket system in accordance with the present invention. The game ticket includes five pull tabs 46 that may be opened to expose five play results 47. A multitude of such game cards may be used with the game ticket system of the first described embodiment.

From the foregoing, it will be appreciated that the present invention provides enhanced entertainment value in game ticket systems. Players have the opportunity for extended periods of excitement and anticipation while playing the live action game of keno. This enhances a player's keno gaming experience and encourages players to remain in the keno gaming establishment during live action keno game play periods. The game ticket system's game tickets may be rapidly sold by a plurality of sales persons or machines to move the game along quickly, maximizing both player enjoyment and provider profits. The game ticket system thus provides enhanced enjoyment for players, and enhanced sale and promotional opportunities for game ticket providers.

While representative embodiments of the invention have been illustrated and described, it will be apparent that various modifications can be made without departing from the spirit and scope of the invention. For example, while the game tickets were depicted as having predetermined play result values, they could be designed with a plurality of exposure devices wherein the player was only allowed to remove some of the devices for a varying game ticket value. Thus, although the invention has been described in detail with reference to the representative embodiments, those having ordinary skill in the art will appreciate that various modifications can be made without departing from the invention. Accordingly, the invention is not intended to be limited, and is defined with reference to the following claims.

I claim:

1. A method of running a game ticket system to be played in conjunction with a live-action gaming system that uses a set of numbers comprising:

distributing a plurality of game tickets to a group of players, each game ticket having one or more play results included thereon, with each play result indicating either a winning play, a losing play or a hold play result and the hold play result identifying a number from a set of numbers used in a live-action gaming system, and one or more removable exposure devices concealing the one or more play results;

removing the one or more exposure devices to reveal the one or more play results;

comparing the hold play results with a number from the set of numbers used in the live-action gaming system corresponding to a predetermined result of the live-action game; and determining which hold play result matches the number corresponding to the predetermined result, where winning the live-action game is independent of being a member of the group of players to which the game tickets were distributed.

2. The method of claim 1, wherein the live action gaming system is a keno gaming system.

3. The method of claim 2, wherein each game ticket has three play results.

4. The method of claim 2, wherein each game ticket has five play results.

* * * * *